United States Patent [19]

Hirozumi et al.

[11] Patent Number: 5,043,624

[45] Date of Patent: Aug. 27, 1991

[54] ELECTRIC LAMP ASSEMBLY HAVING A BAND CONNECTED TO INTEGRALLY FORMED METAL PIECES ON A BASE

[75] Inventors: Yasuo Hirozumi; Mitsuhiro Okano, both of Shizuoka, Japan

[73] Assignee: Koito Manufacturing Co., Ltd., Tokyo, Japan

[21] Appl. No.: 442,977

[22] Filed: Nov. 29, 1989

[30] Foreign Application Priority Data

Dec. 1, 1988 [JP] Japan ..... 63-304951

[51] Int. Cl.[5] ..... H01J 5/48; H01J 5/50; H01K 1/42; H01K 1/66

[52] U.S. Cl. ..... 313/318; 313/579; 313/580

[58] Field of Search ..... 313/318, 578, 579, 580, 313/113

[56] References Cited

U.S. PATENT DOCUMENTS

| | | | |
|---|---|---|---|
| 3,885,149 | 5/1975 | Wolfe et al. | 313/580 X |
| 4,547,838 | 10/1985 | Wakimizu | 313/318 X |
| 4,569,005 | 2/1986 | Bergin et al. | 313/318 |
| 4,631,651 | 12/1986 | Bergin et al. | 439/499 |
| 4,769,574 | 9/1988 | Nagasawa et al. | 313/318 |
| 4,785,218 | 11/1988 | Kohl et al. | 313/318 X |
| 4,812,703 | 3/1989 | Kanematsu et al. | 313/318 |
| 4,864,183 | 9/1989 | Okano | 313/318 |

*Primary Examiner*—Donald J. Yusko
*Assistant Examiner*—Brian Zimmerman
*Attorney, Agent, or Firm*—Browdy and Neimark

[57] ABSTRACT

An electric lamp assembly comprising a lamp bulb a lamp base being essentially formed of a synthetic resin material and a retaining band being made of a metal. A plurality of weldable supporting pieces formed of a metal are integrally formed on the lamp base by insert forming process with the front end portions of the supporting pieces projecting out of the front end portion of the lamp base. A plurality of mounting openings are formed in the retaining band. Respective front end portions of the supporting pieces are inserted through the mounting openings in the retaining band and are welded to edges of the mounting openings respectively.

3 Claims, 7 Drawing Sheets

ELECTRIC LAMP ASSEMBLY HAVING A BAND CONNECTED TO INTEGRALLY FORMED METAL PIECES ON A BASE

FIELD OF THE INVENTION

The present invention relates to a novel electric lamp assembly and, particularly to an electric lamp assembly consisting of a lamp bulb, a base being essentially formed of a synthetic resin material and a retaining band being made of a metal and interposing between the lamp bulb and the base.

DESCRIPTION OF PRIOR ART

FIGS. 7A and 7B show one example of prior art electric lamp assembly, such as shown in Japanese Utility Model Disclosure (Kokai) 62-186367, which consists of a lamp bulb d formed essentially of a glass material, a lamp base a formed of a synthetic resin material and a retaining band e.

A metal sleeve b is fitted on a front end portion of the lamp base a, and a part of the lamp base a is fused by such as super sonic welding process and the like so as to secure the metal sleeve b to the lamp base a. A plurality of projections c, c . . . projecting from the front end of the metal sleeve b are inserted through mounting openings f, f . . . which are formed in the retaining band e which, in turn retains the lamp bulb d. Respective projections c, c . . . are respectively welded to mounting pieces g, g . . . which are provided respectively on one edges of the openings f, f . . . . Whereby the lamp bulb d is secured to the lamp base a.

According to the prior art shown in FIGS. 7A and 7B, the metal sleeve b and the lamp base a have been formed separately and, thereafter, are connected to each other, thus, manufacturing and assembling process are complicated and is expensive.

Further, it is required to form the lamp base a and the metal sleeve b at a high accuracy and to perform the assembling process at a high accuracy.

The present invention aims to satisfy above described requirements and to provide a novel electric lamp.

SUMMARY OF THE INVENTION

According to the invention, there is provided an electric lamp assembly comprising a lamp bulb, a lamp base being formed essentially of a synthetic resin material and a retaining band being made of a metal and interposed between the lamp bulb and the lamp base;

a plurality of weldable supporting pieces formed of a metal are integrally mounted on the lamp base by insert forming process with the front end portions of the supporting pieces projecting out of the front end portion of the lamp base; a plurality of mounting openings are formed in the retaining band; and the front end portions of the supporting pieces are respectively inserted through the mounting openings in the retaining band and are welded to edges of the mounting openings respectively.

The process for retaining the lamp bulb on the lamp base can be simplified, since the metal supporting pieces located between the lamp base and the retaining band are integrally mounted on the lamp base by insert forming process, thus, it is possible to mount the lamp bulb at a high accuracy thereby improving the overall accuracy.

BRIEF DESCRIPTION OF THE DRAWINGS

Further objects and effects of the invention will become apparent from the following detailed description in conjunction with the drawings, in which:

FIG. 1 is an exploded perspective view;

FIG. 2 is a perspective view of assembled condition;

FIG. 3 is a longitudinal section view;

FIG. 4 is a longitudinal section view taken at the position different from that of FIG. 3;

FIG. 5 is an enlarged front view of a retaining band;

FIG. 6 is an enlarged section view taken generally along line VI—VI in FIG. 5;

DETAILED DESCRIPTION OF PREFERRED EMBODIMENTS

FIG. 1 through FIG. 6 show a preferred embodiment of the present invention as applied on a Halogen electric lamp assembly.

Figure 1:
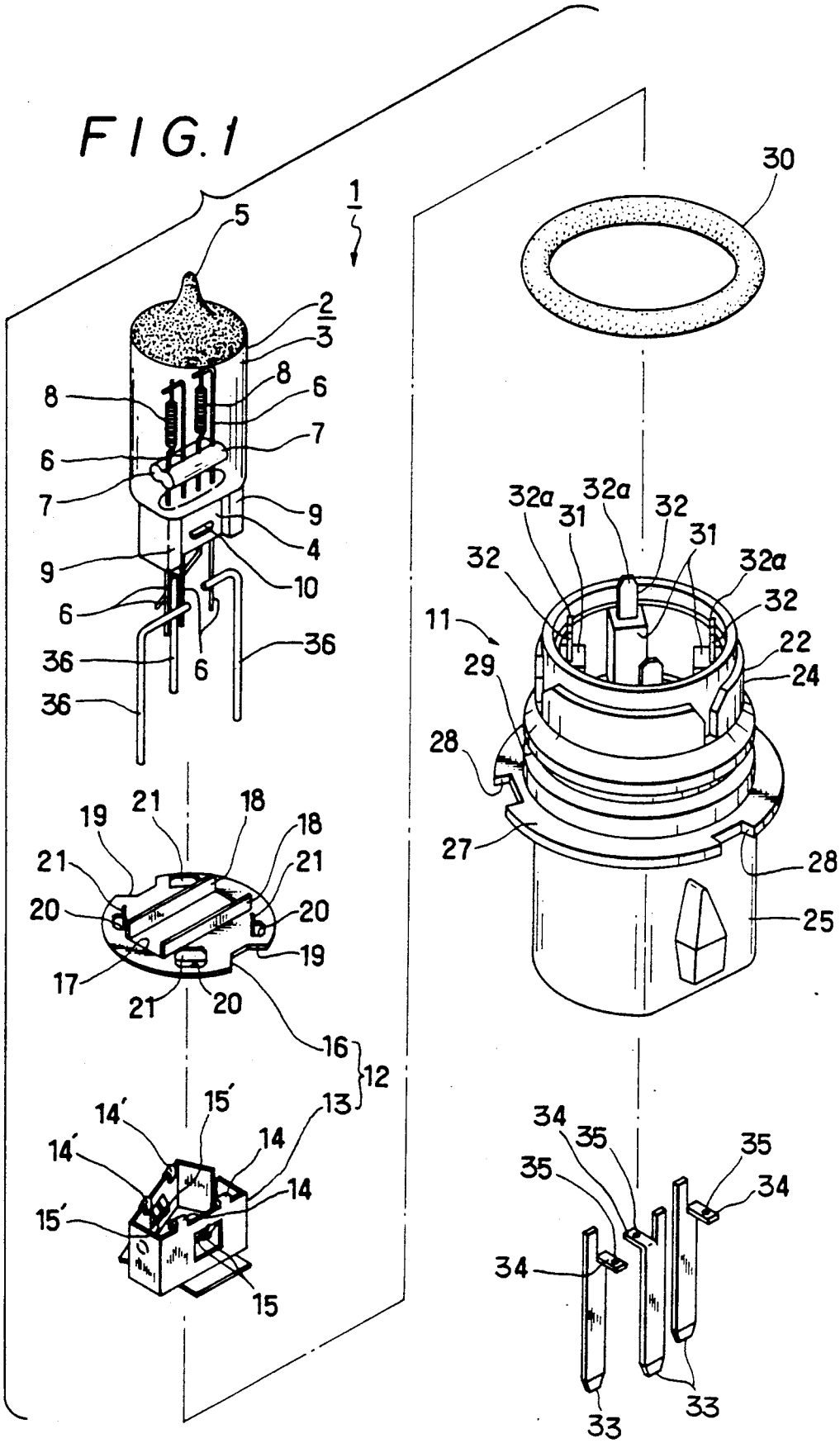
FIG. 1 through FIG. 6 show an electric lamp assembly according to one embodiment of the present invention.

In the specification, the wording "front" means the direction upward in FIG. 1 and "rear" means the direction downward in FIG. 1.

Lamp Bulb (FIG. 1 through FIG. 4)

Shown at 2 is a lamp bulb of the Halogen electric lamp assembly 1, and includes a glass bulb 3 with the rear end portion being sealed by a pinch seal portion 4 and the front end portion being sealed by an air extracting portion 5. A plurality of lead wires 6, 6 . . . extend through the pinch seal portion 4 to extend between the outside and inside of the glass bulb 3. Glass bridges 7 and 7 are provided inside of the glass bulb 3 and are welded together to clamp therebetween the lead wires 6, 6 . . . , Filaments 8 and 8 are extended between tip ends of suitable lead wires 6, 6 . . . .

The pinch seal portion 4 has a generally flat shape and has on opposite sides ridges 9, 9 . . . so as to have a generally I-shaped cross-section. There are formed, on opposite side surfaces of the pinch seal portion 4, retaining projections 10 and 10 (only one is shown in FIG. 1).

The glass bulb 3 receives therein inert gas and a suitable Halogen gas to constitute the lamp bulb 2.

Lamp mounting means (FIG. 1 through FIG. 6)

The lamp bulb 2 is supported on a lamp mounting means 11 through a retaining band 12. The lamp mounting means 11 has a lamp base 22 which is adapted to be supported on a lamp body of a headlight and a metal supporting pieces 32, 32 . . . for supporting the retaining band 12.

Retaining Band (FIG. 1 through FIG. 6)

The retaining band 12 consists of a bulb retaining portion 13 for clamping and retaining the pinch seal portion 4 of the lamp bulb 2 and a supported portion 16 being adapted to be connected to the lamp base 22.

The bulb retaining portion 13 has a rectangle tubular shape as viewed in fore and aft direction and is formed of nickel silver preferably. The bulb retaining portion 13 further has front side resilient retaining portions 14, 14 and 14', 14' on the front edge of the portion 13 and being bent inner and rear directions, and rear side resilient retaining portions 15, 15 and 15', 15' which are formed in opposite side surfaces of the portion 13 by cutting into the inner direction to extend obliquely in the rear and inner direction with tip ends 15*a*, 15*a* and 15'*a*, 15'*a* extending in the rear direction.

The supported portion 16 is preferably formed of a stainless steel and has a generally disc shape, and has a mounting opening 17 in the central portion. The shape of the opening 17 is adapted to snugly receive the bulb retaining portion 13. There are formed respectively on the longer sides of the opening 17 supporting pieces 18 and 18 to project in the front direction (upward in FIG. 1). Further, there are formed cutouts 19 and 19 in opposite sides of the supported portion 16, a plurality of mounting openings 20, 20, . . . in spaced apart positions near to the circumference of the supported portion 16, and supporting pieces 21, 21 . . . extending forward from respective radially inner edges of the mounting openings 20, 20, . . . respectively.

The rear end portion of the bulb retaining portion 13 is fitted in the mounting opening 17 of the supported portion 16 and the side surfaces thereof are secured by spot welding to respective supporting pieces 18 and 18 respectively.

The pinch seal portion 4 of the lamp bulb 2 is fitted into the bulb retaining portion 13 of the retaining band 12 such that the resilient retaining pieces 14, 14, 14', and 14' engage resiliently with radially inner surfaces of the ridges 9, 9 . . . and the resilient retaining pieces 15, 15, 15' and 15' engage resiliently with the front surfaces of the retaining projections 10 and 10, whereby the lamp bulb 2 is reliably mounted on the retaining portion 13 of the retaining band 12.

Lamp base (FIG. 1 through FIG. 4)

The lamp base 22 is preferably mold formed of a thermoplastic synthetic resin material and has generally tubular shape, with the inner side being partitioned to a bulb supporting portion 24 and a connector portion 25 by a partition wall 23. The wall 23 has therein mounting holes 26 and 26. A flange 27 is integrally formed on the outer circumference of the lamp base 22 and has therein three locating cutouts 28, 28 and 28 (only two of which are shown in the drawings).

An annular groove 29 is formed in the outer periphery of the lamp base 22 and receives therein a seal member 30 such as an O-ring which acts to seal the space between the lamp base 22 and a lamp body when the electric bulb is mounted on the lamp body.

There are formed in the bulb supporting portion 24 a plurality of (preferably, four) supporting columns 31, 31 . . . extending forward in the axial direction with the front ends thereof being slightly rearward of the front end of the lamp base 22.

There are provided a plurality of terminals 33, 33 and 33 in the lamp base 22 which will be explained hereinafter.

Metal Supporting Pieces (FIG. 1 through FIG. 4)

In the supporting columns 31, 31 . . . there are embedded metal supporting pieces 32, 32 . . . with the front end portions 32*a*, 32*a* . . . projecting out of the front ends of the supporting columns 31, 31 . . . respectively. Such construction can easily be formed by such as insert forming process in which the portions 32*a*, 32*a* . . . of the metal supporting pieces 32, 32 . . . are supported in the wall of the mold cavity so that remaining portions of the metal supporting pieces 32, 32 . . . project into the mold cavity, and molten resin is injected into the mold cavity, thereby the metal supporting pieces 32, 32 . . . are embedded.

Figure 3:
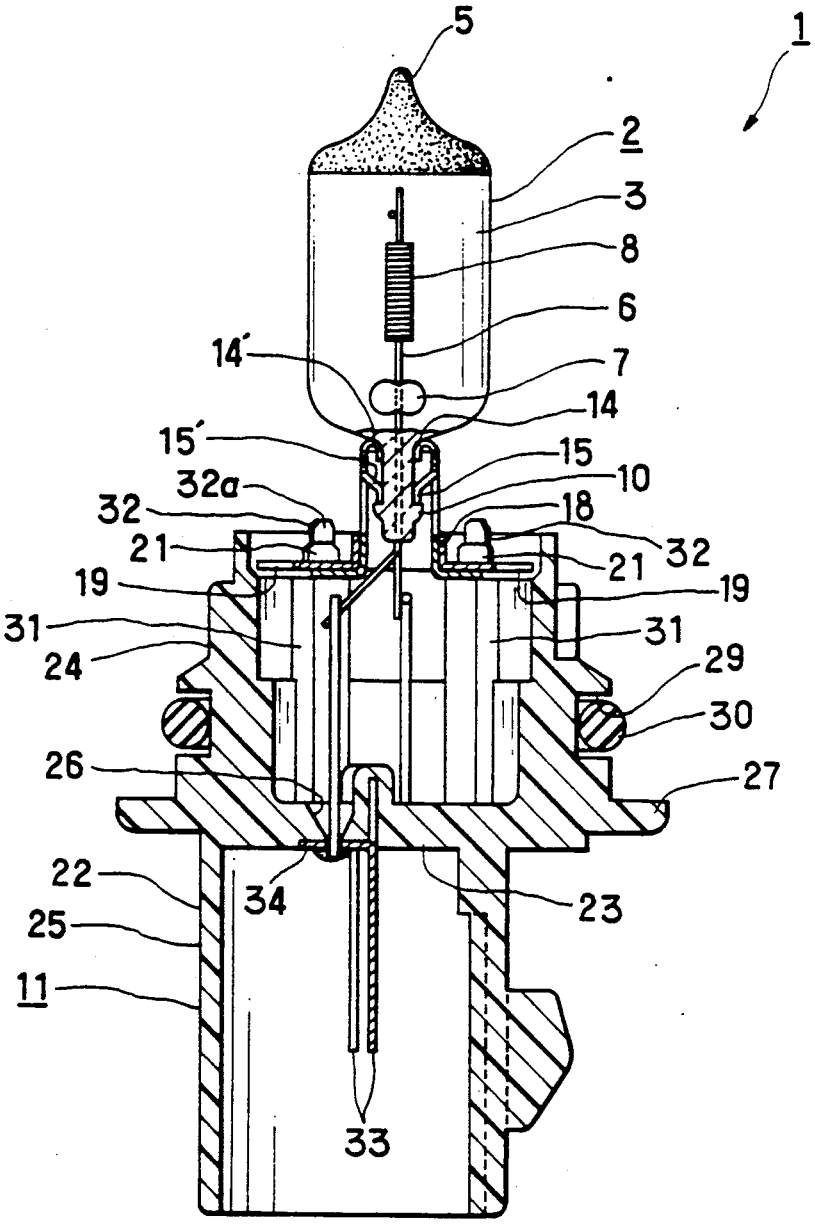
Figure 4:
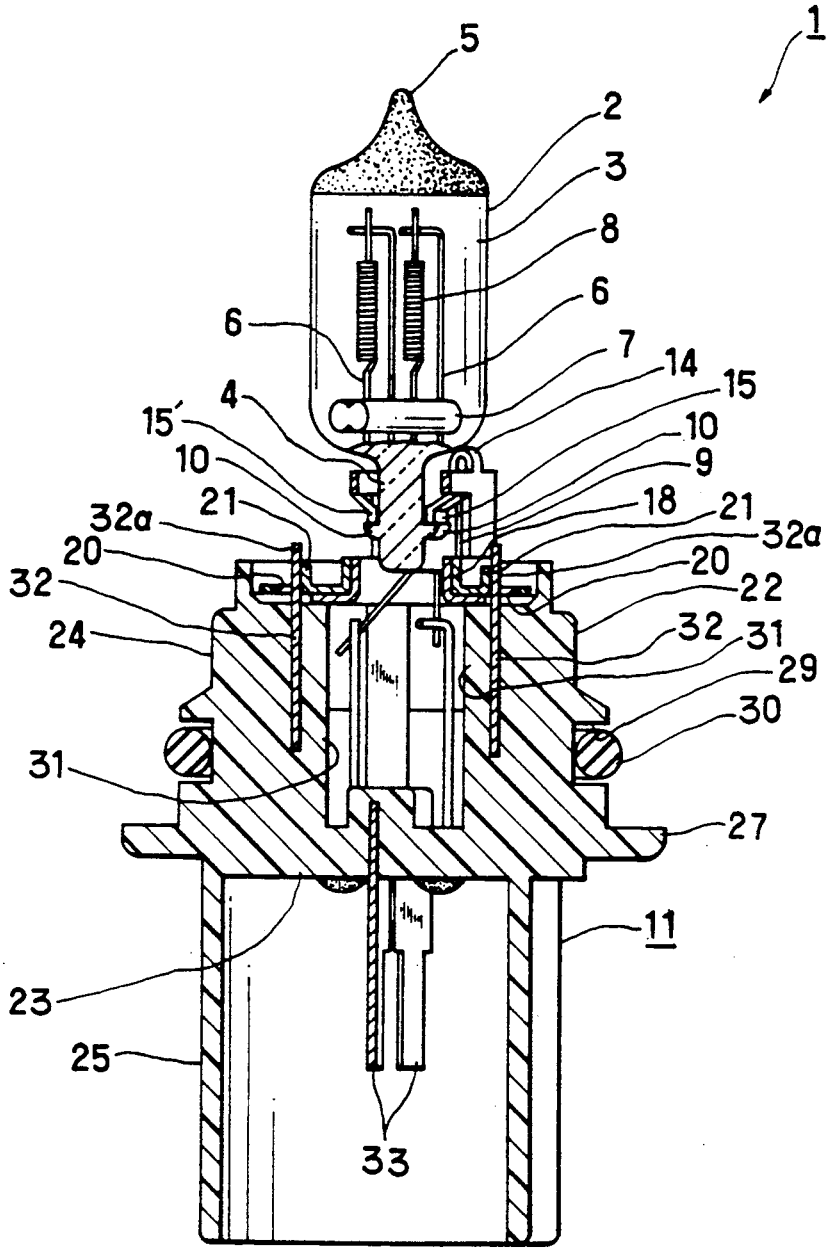
Figure 5:
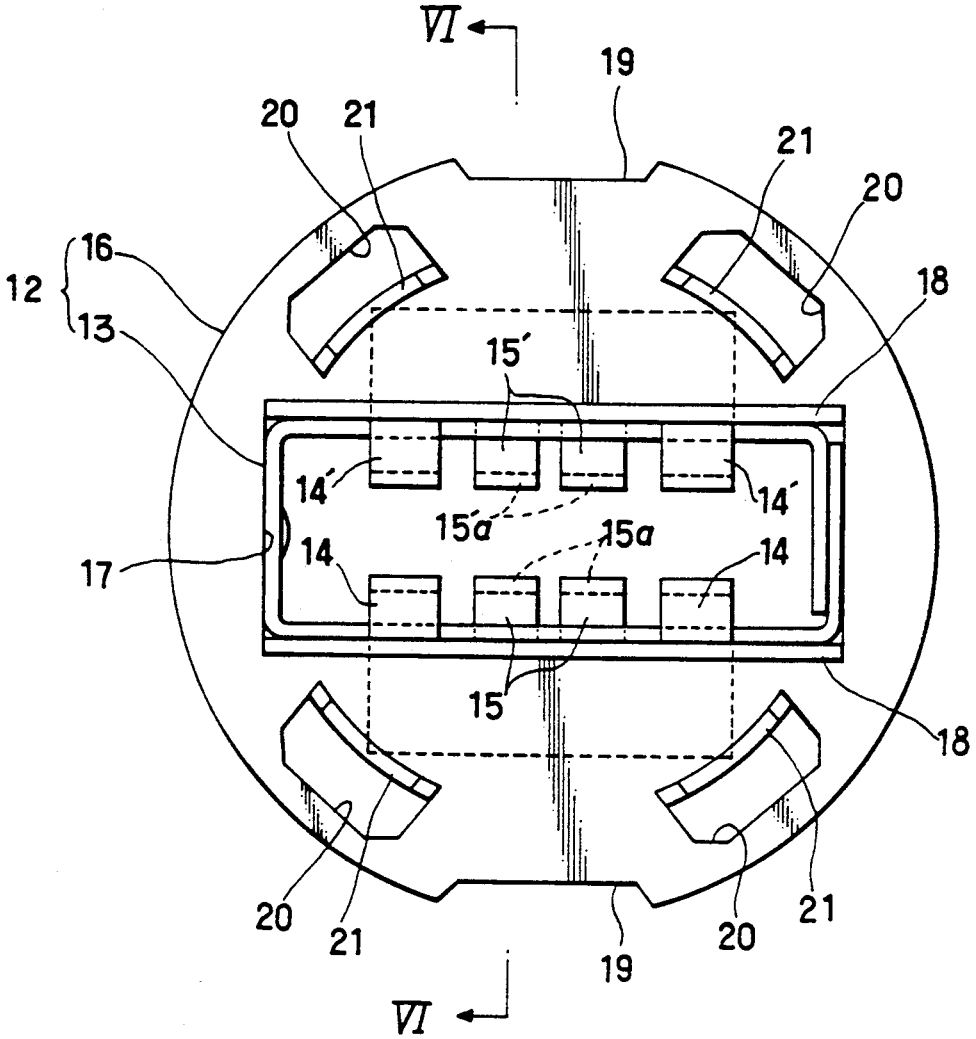
Figure 6:
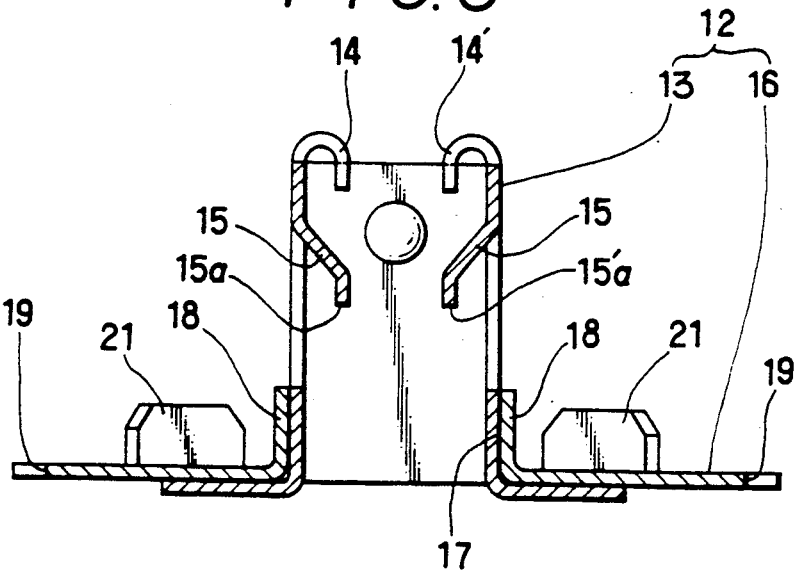
Figure 7A:
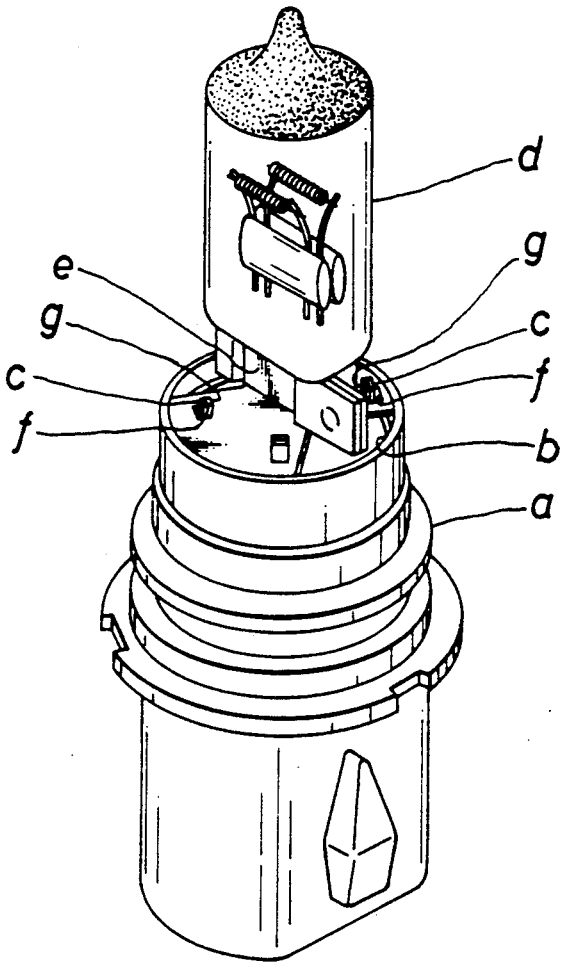
FIG. 7A PRIOR ART
FIG. 7A is a perspective view of essential portion of a prior art electric lamp assembly.
Figure 7B:
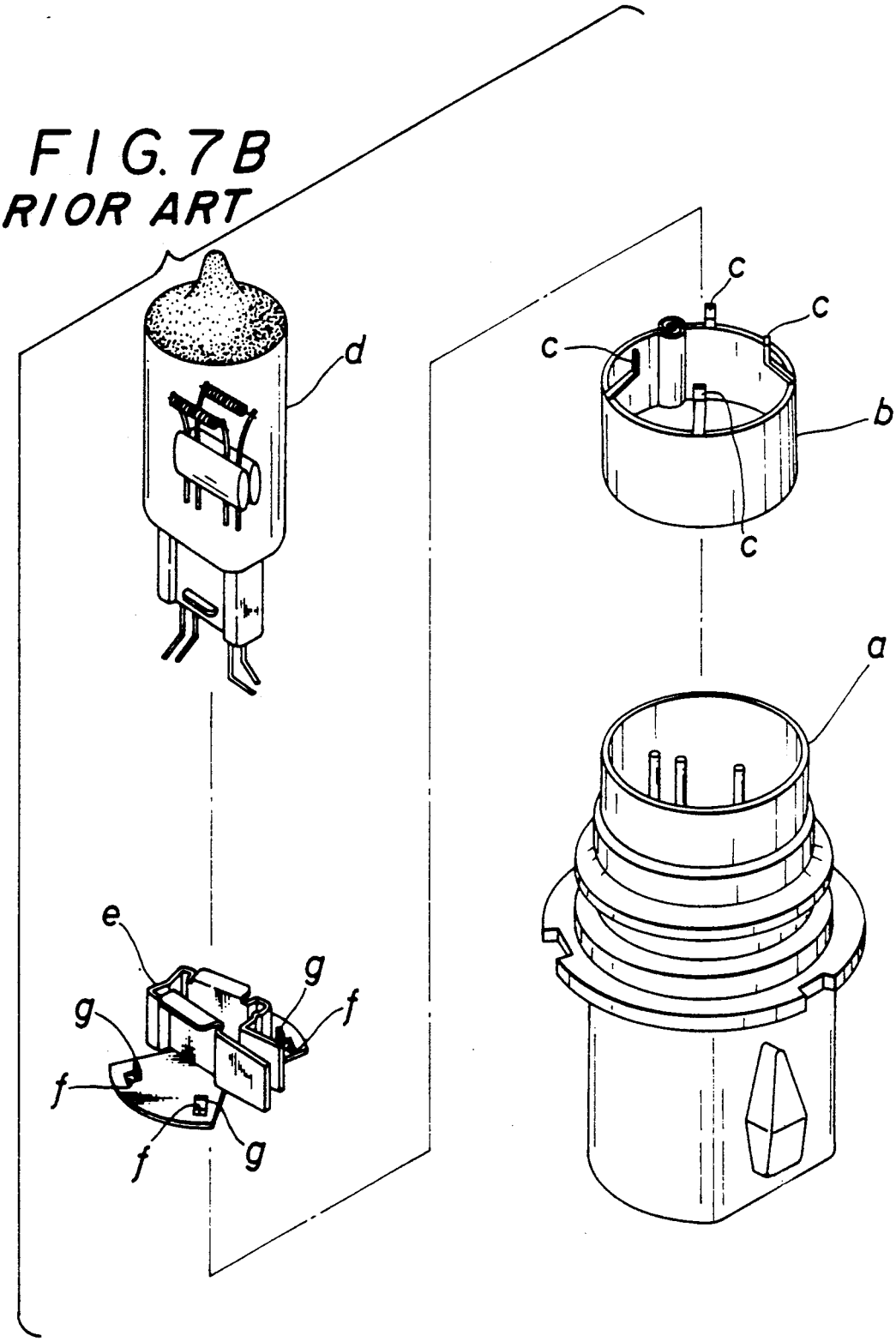
FIG. 7B PRIOR ART
FIG. 7B is an exploded perspective view of the electric lamp assembly of FIG. 7A.

Terminals (FIG. 1, FIG. 3 and FIG. 4)

A suitable number of, preferably corresponding to the number of the lead wires 6, 6 and 6 of the lamp bulb 2, terminals 33, 33 and 33 are mounted in the lamp base 22. Each terminal 33 has, adjacent to the front end thereof, a perpendicularly bent mounting piece 34 having therein a mounting hole 35.

The front end portions and the mounting pieces 34, 34 and 34 of the terminals 33, 33 and 33 are integrally embedded in the partition wall 23 of the lamp base 22 by such as insert molding process, with the mounting holes 35, 35 and 35 aligning respectively with the mounting holes 26, 26 and 26 in the partition wall 23. Thus, the terminals 33, 33 and 33 are mounted in the connector portion 25 of the lamp base 22.

Connecting Line (FIG. 1, FIG. 3 and FIG. 4)

There are provided connecting lines 36, 36 and 36 with the front ends of which being connected respectively to lead wires 6, 6 and 6 by such as spot welding process.

Mounting Retaining Band on Lamp Base

Figure 2:
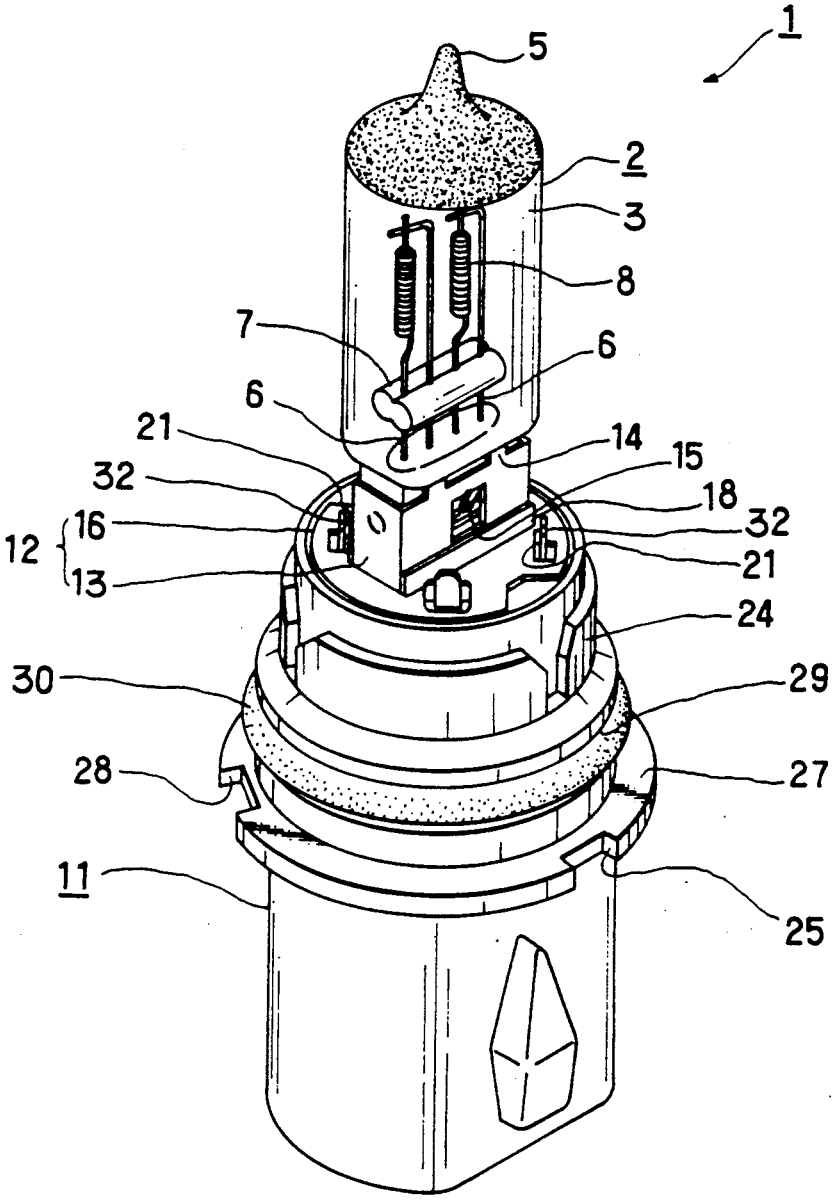

As shown in FIGS. 2–4, the retaining band 12 with the lamp bulb 2 being retained thereon is mounted on the lamp base 22 according to following steps.

The front end portions 32*a*, 32*a* . . . of the metal supporting pieces 32, 32 . . . , which are secured to the lamp base 22, are inserted respectively through mounting openings 20, 20 . . . in the retaining band 12 by displacing the retaining band 12 relative to the lamp base 22 with the positional relationship between the filaments 8 and 8 in the bulb 3 and the flange 27 of the lamp base 22 being maintained properly. The front end portions 32*a*, 32*a* . . . of the metal supporting pieces 32, 32 . . . are secured respectively to the supporting pieces 21, 21 . . . of the retaining band 12 by such as plasma welding process.

In parallel to above described process, the rear ends of the connecting wires 36, 36 and 36 are respectively inserted through the mounting holes 26, 26 and 26 in the partition wall 23 of the lamp base 22 and through the mounting holes 35, 35 and 35 in the terminals 33, 33 and 33. When desired positional relationship between the filaments 8 and 8 in the lamp bulb 2 and the flange 27 of the lamp base 22 is obtained, the rear ends of the connecting wires 36, 36 and 36 are respectively secured to the mounting pieces 34, 34 and 34 of the terminals 33, 33 and 33 by such as soldering.

Thus, the lamp bulb 2 is secured to the lamp base 22 through the retaining band 12 and the metal supporting pieces 32, 32 . . . .

Effects of the Invention

As described heretofore, the electric lamp assembly according to the invention comprises a lamp bulb, a lamp base being essentially formed of a synthetic resin material and a retaining band being made of a metal. A plurality of weldable supporting pieces made of a metal are formed integrally on the lamp base by insert forming process with the front end portions of the supporting pieces projecting out of the front end portion of the lamp base. A plurality of mounting openings are formed in the retaining band. And the front end portions of the supporting pieces are respectively inserted through the mounting openings in the retaining band and are welded to edges of the mounting openings respectively.

Therefore, the metal supporting pieces connecting the lamp base and the retaining band retaining the lamp bulb are integrally formed with the lamp base by insert forming process. Thus, the metal supporting pieces are assembled integrally with the lamp base during the insert forming process for forming the lamp base which enables to simplify the assembling step and to reduce the cost. Further, the assembling accuracy between the metal supporting pieces and the lamp base depends on the accuracy of the metal mold for forming the lamp base which can substantially be improved as compared with prior art.

We claim:

1. An electric lamp assembly comprising a lamp bulb, a lamp base being essentially made of a synthetic resin material and a retaining band being made of metal; a plurality separate metallic weldable supporting pieces integrally formed on the lamp base by an insert forming process with front end portions of the supporting pieces (32) projecting out of the front end portion of the lamp base; a plurality of mounting openings which are formed in the retaining band (20); the front end portions of the supporting pieces are inserted through the mounting openings in the retaining band and are welded respectively to edges of the mounting openings, and wherein the lamp base has generally tubular shape having an intermediate partition wall therein, respective metal supporting pieces are respectively embedded integrally in supporting columns which are integrally formed on the partition wall of the lamp base, and the front end portions of the supporting pieces project out of the front ends of respective supporting column.

2. An electric lamp assembly according to claim 1, wherein the retaining band has a disc shaped portion having therein a plurality of said mounting openings and further having a rectangular tubular portion being secured to said disc shaped portion and has a means for receiving and retaining a pinch seal portion of the bulb.

3. An electric lamp assembly according to claim 2, wherein said disc shaped portion and the rectangular tubular portion of the retaining band are secured together by welding process.

* * * * *